US011008704B2

(12) United States Patent
Smyrniotis et al.

(10) Patent No.: US 11,008,704 B2
(45) Date of Patent: May 18, 2021

(54) DEPOSIT CONTROL FOR A BLACK LIQUOR RECOVERY BOILER

(71) Applicant: Fuel Tech, Inc., Warrenville, IL (US)

(72) Inventors: Chrstopher R. Smyrniotis, St. Charles, IL (US); Ian Saratovsky, Highland Park, IL (US); Edward G. Schaub, Wheaton, IL (US); Scott Bohlen, Bucksport, ME (US)

( * ) Notice: Subject to any disclaimer, the term of this patent is extended or adjusted under 35 U.S.C. 154(b) by 540 days.

(21) Appl. No.: 15/665,564

(22) Filed: Aug. 1, 2017

(65) Prior Publication Data

US 2019/0040577 A1 Feb. 7, 2019

(51) Int. Cl.
*D21C 11/12* (2006.01)
*D21C 11/00* (2006.01)

(52) U.S. Cl.
CPC ..... *D21C 11/0092* (2013.01); *D21C 11/0057* (2013.01); *D21C 11/12* (2013.01)

(58) Field of Classification Search
USPC ..... 162/30
See application file for complete search history.

(56) References Cited

U.S. PATENT DOCUMENTS 5,715,763 A 2/1998 Fometti et al.
5,740,745 A 4/1998 Smyrniotis et al.
2017/0218408 A1* 8/2017 Baets ..... C12P 7/56

OTHER PUBLICATIONS

Black Liquor and The Black Liquor Recovery Boiler—Unknown—Date believed to be in 2015, https://docplayer.net/30369396-Black-liquor-and-the-black-liquor-recovery-boiler.html.

* cited by examiner

*Primary Examiner* — Jacob T Minskey
(74) *Attorney, Agent, or Firm* — Thaddius J. Carvis

(57) ABSTRACT

Disclosed is a process for reducing slag in a black liquor recovery boiler, the process comprising: injecting and burning black liquor in a boiler by contacting it with primary air and secondary air; introducing a slag-reducing chemical into the gases above the injection locations through interlaced, tangential or concentric secondary, tertiary, and/or quarternary air ports.

9 Claims, 2 Drawing Sheets

DEPOSIT CONTROL FOR A BLACK LIQUOR RECOVERY BOILER

BACKGROUND OF THE INVENTION

The invention relates to a new technology that controls slag and fouling deposits in a black liquor recovery boiler, which utilizes black liquor produced as a byproduct of pulp making to recover heat and pulping chemicals.

Paper production involves the treatment of wood chips with chemicals to digest chips into pulp, which is used as a feedstock for either paper manufacture or dissolving pulp. The digestion of wood chips by white liquor (i.e., NaOH and $Na_2S$) produces Kraft pulp (often referred to as delignified or cellulosic pulp) and black residue called black liquor, which is a combination of organic residues and spent pulp digester chemical. As an approximate estimate, the production of 1,000 tons of Kraft pulp can result in the formation of 1,500 tons of black liquor. Owing to the large quantity of spent chemical generated and relative high cost of fresh digestion/pulping chemicals, black liquor can be fired in a recovery boiler to generate thermal steam and regenerate pulping chemicals to be recycled back into the pulping process.

Pulp produced by digestion with white liquor is washed, and spent digestion chemicals are recovered and recycled back to the digestion process. The original pulping chemicals (i.e., white liquor) can be regenerated following digestion by separating the black liquor from pulp, evaporating excess water from the black liquor, and burning the black liquor in a recovery boiler to create heat and smelt (i.e., molten sodium salts, predominantly $Na_2CO_3$ and $Na_2S$). The smelt forms at the bottom of the boiler and is dissolved in water to produce "green liquor". The clarified green liquor is reacted with calcium hydroxide to convert $Na_2CO_3$ to NaOH (i.e., causticizing) to produce a white liquor that contains $Na_2S$ and NaOH. The white liquor is subsequently recycled to the digester.

The black liquor, following evaporation, forms a high viscosity, black material, which is liquid only at elevated temperatures. Black liquor contains organic residues from the delignification process and—as a result—black liquor has a heating value and can be fired in a black liquor recovery boiler. The inorganic fraction of the black liquor primarily consists of relatively low melting temperature sodium salts, predominantly in the form of sodium hydroxide, sodium sulfide, sodium sulfate, and sodium carbonate. Owing to the low melting points of sodium salts (often <850° C.), firing black liquor can result in deposition of molten or vapor phase sodium salts on heat exchange surfaces (i.e., slagging and fouling, respectively). Deposition on heat exchanger surfaces decreases the boiler efficiency and ultimately leads to pluggage and mandatory boiler shutdown, resulting in loss of pulp production.

Black liquor is difficult to handle and burn, but engineering experience has determined that it can be sprayed into a combustion zone of a black liquor recovery boiler by nozzles of various design, including splash plate, swirlcone, V-type and beer can design. The spray enters the boiler at the correct temperature and droplet size distribution to permit best utilization. The injectors (often referred to as "liquor guns") penetrate the vertical boiler walls above a char bed (also called a char pile) and desirably above the primary and secondary air ports, but below the tertiary and quaternary air ports. The injectors typically spray the black liquor from opposite walls with droplet velocity and momentum sufficient that a majority reaches beyond the midpoint of the boiler but none reaches the opposite wall by the time the droplets fall to the char pile. Some volatiles are removed in the descent to the pile and some carbonization is effected, but the main burning of the black liquor occurs under reducing conditions in the char pile (to promote reduction of $Na_2SO_4$ to $Na_2S$). Primary air is introduced at the approximate elevation of the char pile and supplies about 40 percent or less of the stoichiometric oxygen. Secondary air is introduced below the injection points for the black liquor and adds another 30 to 50 percent of the needed air. Above the level of the black liquor guns are ports for additional air, typically tertiary air and sometimes quaternary air. These additional air ports are essential to supply sufficient air to complete the combustion process and produce process steam.

The combustion gases rising through the recovery boiler contain carryover ash formers (which cool to form ash) which are desirably recovered as solids in an electrostatic precipitator or other solids recovery equipment. Unfortunately, the ash from burning the black liquor will often contain components that cause it to act as an adhesive mass until it passes beyond a bull nose at the top of the combustion zone and into contact with an array of heat exchangers, such as those that form the screen tubes, super heater, the boiler bank (or reheat) and the economizer. The adhesive molten and gaseous sodium salts that are entrained within the flue gas condense on cooler heat exchange surfaces, resulting in deposition. Deposit formations continue to grow as the black liquor recovery boiler is operated, resulting in pluggage and hazardous slag falls, which result in boiler shutdowns and potentially dangerous conditions. For example, large slag falls can puncture or crack exposed screen tubes and release water onto the char bed. Owing to reducing conditions at the char bed, water is converted to hydrogen and oxygen, which pose a serious explosion hazard. Keeping the black liquor recovery boiler free of deposits is critical to maintain safe continuous operations and minimize explosion risks. Deposit control chemicals/additives and processes are known, but it is always a challenge to introduce them in a manner effective for black liquor recovery boilers. This problem has existed since the first such boilers were made and there have been only a few successes, and none which have universal effectiveness.

One established technology for achieving effective slag control in some black liquor recovery boilers is described in U.S. Pat. No. 5,740,745 to Smyrniotis, et al.; however, due to the way combustion occurs in a black liquor recovery boiler, there appears to be a unique set of requirements for introducing slag control chemicals. Because of internal structural variations among boilers, the flow of gases in the boilers is not always sufficiently regular to permit accurate and effective computational fluid dynamic solutions. Some physical obstructions such as internal support trusses or beams (and other structures added as retrofit for reasons peculiar to individual boilers) and heat transfer anomalies cannot be reliably modeled in some cases. The introduction of air at multiple levels can cause problems that are not easily seen and addressed. In addition, many predicted solutions require creating openings in boiler walls, often through water walls or other difficult locations. Accordingly, there is a need for a process that can supply the necessary chemical or chemicals despite the problems.

There is a need for an improved process that more effectively applies chemical additives to control deposit formation in a black liquor recovery boiler.

DISCLOSURE OF THE INVENTION

It is an object of the invention to provide a new technology that controls slag in a black liquor recovery boiler.

It is another object to provide a process that controls slag in a black liquor recovery boiler with minimal modification of boiler walls.

In one aspect, the invention provides a process for reducing deposits in a black liquor recovery boiler, the process comprising: injecting and burning black liquor in a boiler by injecting it into the boiler and into contact with primary air and secondary air before collecting on a char bed in the boiler near the bottom; introducing deposit-reducing chemical into the gases above the black liquor guns through secondary, tertiary, and/or quaternary air ports, which are often present in an interlaced configuration or at the corners of boiler walls (often called tangential or concentric air pattern).

In another aspect, the apparatus for introducing the deposit-reducing chemical is provided.

Other preferred aspects and their advantages are set out in the description which follows.

BRIEF DESCRIPTION OF THE DRAWINGS

The invention will be better understood and its advantages will become more apparent when the following detailed description is read in conjunction with the accompanying drawings, in which.

DETAILED DESCRIPTION OF THE INVENTION

Figure 1:
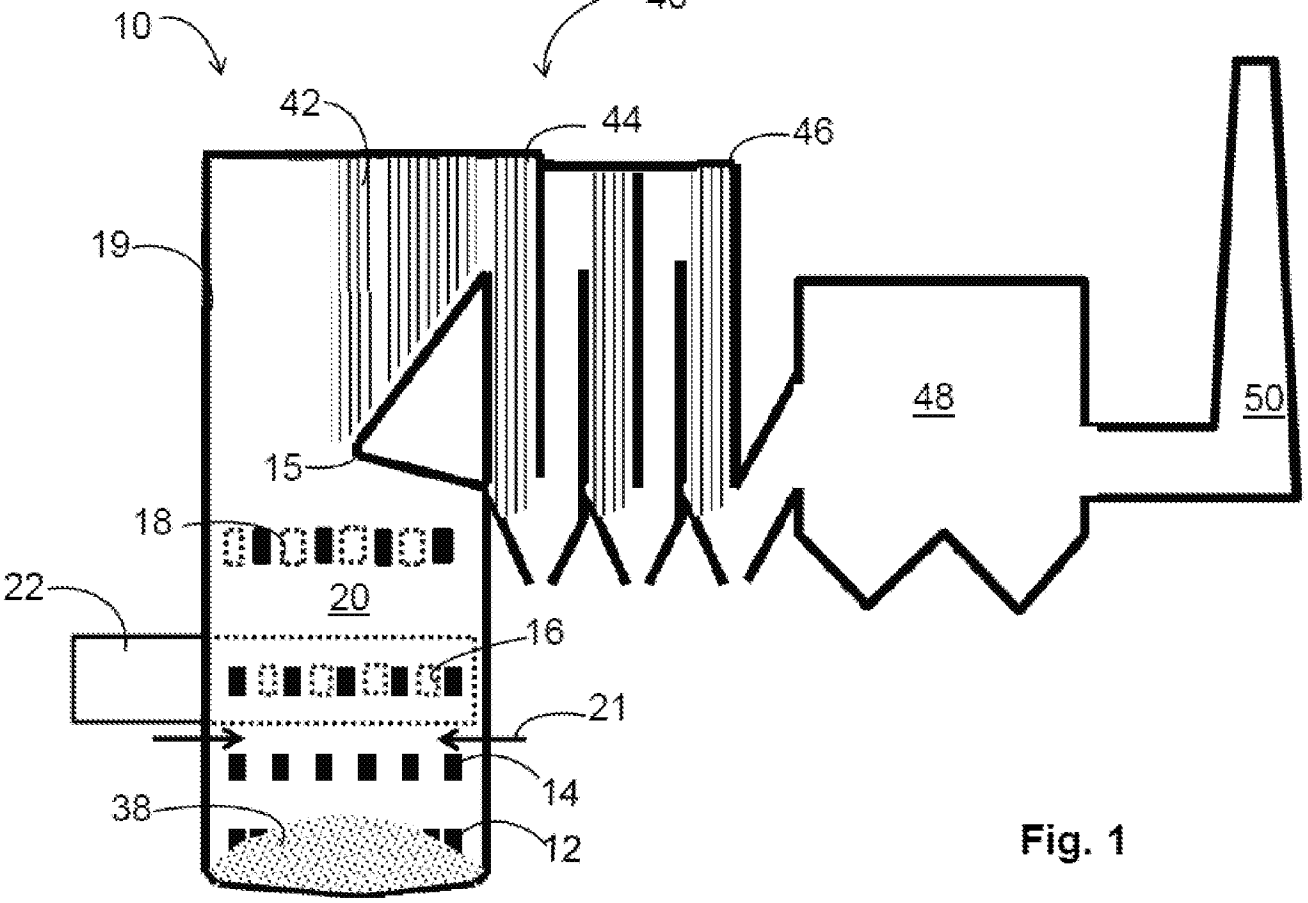
FIG. 1 is a schematic view of one embodiment showing a black liquor recovery boiler with interlaced tertiary and quaternary air ports through which deposit-reducing chemical is introduced.

Reference will first be made to FIG. 1, which is a schematic view of one embodiment showing a black liquor recovery boiler with interlaced tertiary and quaternary air ports through which deposit-reducing chemical can be introduced. FIG. 1 shows a black liquor recovery boiler 10 having primary air ports 12, secondary air ports 14, tertiary air ports 16 and quaternary air ports 18. The boiler has four vertical walls 19, and the air ports are positioned on opposite vertical walls. Black liquor is heated until flowable and introduced into the combustion chamber 20 through nozzles/liquor guns 21 positioned above secondary air ports 14 but below the tertiary air ports 16. Importantly, the secondary and tertiary air ports 16 are arranged in what is known as interlaced fashion, with each port on one vertical wall being laterally offset from ports on the opposing vertical wall such that the air from each port is able to move the maximum distance across the boiler without direct impingement by air from the other side. In other arrangements, the air ports can be in tangential or concentric configurations to promote mixing of the chemicals with combustion gases after introduction. This embodiment conveys air in high volume to the air ports by means of a manifold 22 to carry sprays of deposit-reducing chemicals/additives from nozzles 30 (best seen in FIG. 2) positioned in the tertiary air ports and direct them across the cross section of the boiler to achieve complete mixing of the deposit-reducing chemicals in a section above nozzles used to introduce the black liquor and primary combustion air. The momentum of the spray droplets is greatly increased from direct injection with the tertiary air flow.

In similar arrangements, deposit-reducing chemical can be introduced through the secondary air ports 14 or quaternary air ports 18. In each case described, a similar effect is achieved using the air flow from the noted ports as a driver to provide excellent mixing and distribution within the combustion chamber 20 in advance of the bull nose 15.

Figure 2:
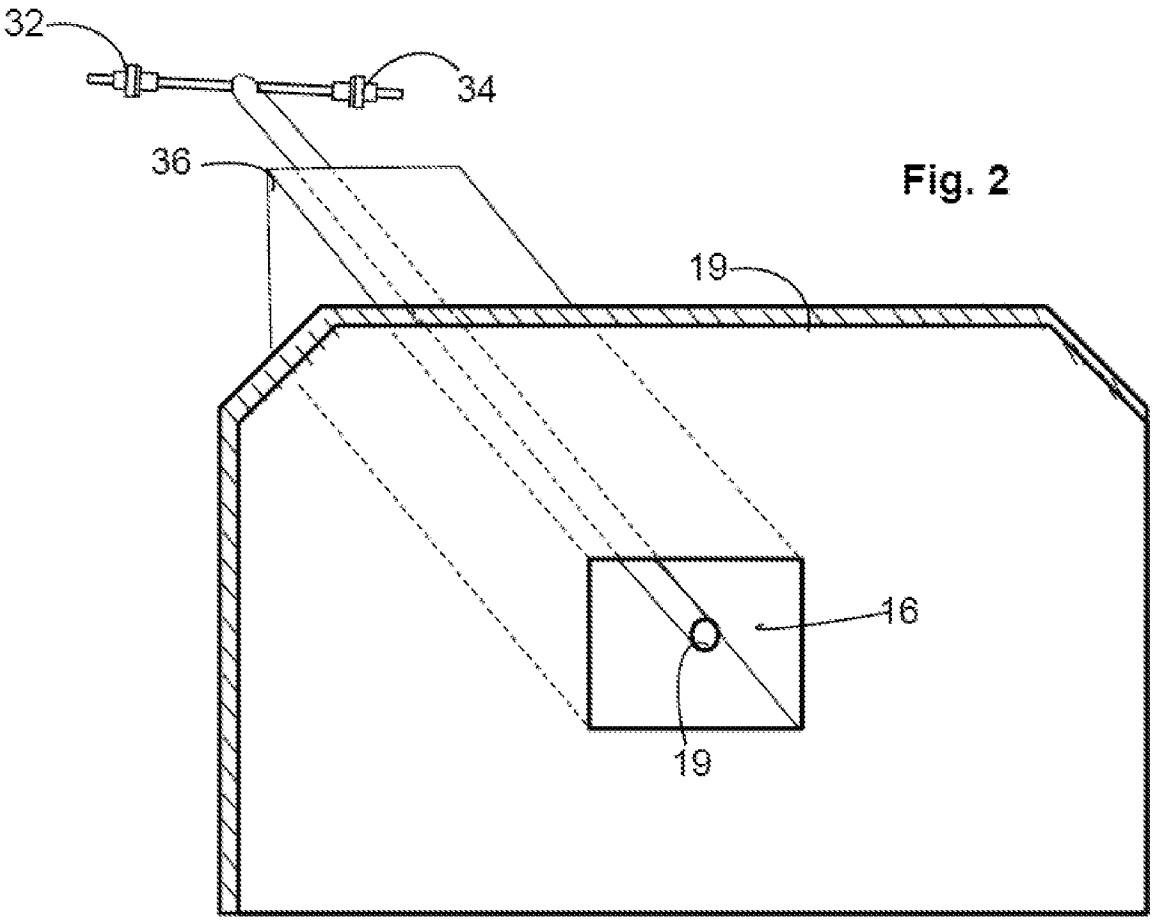
FIG. 2 is a schematic view of one arrangement of injectors for deposit-reducing chemicals in an air port according to the invention.

FIG. 2 is schematic view of one embodiment of the invention wherein a two-phase deposit-reducing chemical nozzle 30 is shown positioned in a tertiary air port 16. The injectors are preferably two phase injectors and utilize air supplied via line 32 to atomize an aqueous slurry of the slag-reducing chemical supplied via line 34. Other nozzle arrangements that permit a high degree of independent penetration and mixing with the hot combustion gases in the combustion chamber 20 can be utilized also. Shown is a nozzle 30 positioned in a rectangular duct 36, which is positioned in each port 16, preferably centrally and set close to flush with the exit of the duct. For a boiler designed to burn 1,000-2,000 tons per day of black liquor, there will typically be from 4 to 8 tertiary ducts of an approximate dimension of from 4" by 4", to 18" by 18", and a horizontal length of from 2 feet to 12 feet. They are preferably spaced laterally along the furnace wall to achieve good air distribution. In embodiments, the flow from at least half of the ducts 32 will be plug flow, which will help shield the injected chemical from too-rapid dispersion before sufficient penetration and permits the air to carry the chemical well into the boiler. To achieve plug flow of air from duct 36 it will be understood that the flow rates can be adjusted so that the hydraulic diameter does not exceed a calculated mean velocity. And, during the design phase, the hydraulic diameter of the velocity of air from the duct must be sufficient to project the deposit reducing chemical from the nozzles from 60 to 95%, e.g., at from 60 to 90%, of the distance across the furnace from the point of injection.

The spray of black liquor from each of nozzles 21 positioned below the tertiary air ports enters the combustion chamber 20 of the boiler 10 at the correct temperature and droplet size to permit best utilization. Typical temperatures of the black liquor will be from 300° F. to 400° F., and droplets will be in the range of from 0.5 mm to 5 mm following impingement onto the splash plates of the injectors. The sprays from the injectors penetrate the vertical boiler walls above a char bed 36 and desirably above primary and secondary air ports, 12 and 14, respectively. The injectors typically spray the black liquor from opposite walls with droplet velocity and momentum sufficient that a majority reach beyond the midpoint of boiler but none reach the opposite wall by the time the droplets fall to the char bed 36.

The elevated temperatures in the combustion chamber 12, cause some volatiles to be removed in the fall of the black liquor to the char bed 36 and some carbonization is effected, but the main burning of the black liquor occurs under reducing conditions in the char pile. Primary air is introduced at the approximate elevation of the char pile and supplies about 40 percent or less of the stoichiometric oxygen. Secondary air is introduced below the black liquor guns and adds another 30 to 50 percent of the needed air. Above the black liquor injectors are ports for additional air (e.g., from 30 to 50 percent), typically tertiary air and sometimes quaternary air. These additional air ports are essential to supply sufficient air to obtain maximum combustion without unduly cooling combustion gases which are required to heat steam to produce utilizable energy. Quaternary air may comprise 20 to 50 percent of the needed air.

The combustion gases rising through the boiler contain ash formers (carryover and fume) and unburned char which are desirably recovered as solids in an electrostatic precipitator or other solids recovery equipment, e.g., generally shown as 48. Unfortunately, the ash from burning the black liquor will often contain components that maintain it as an adhesive mass until in passes beyond a bull nose 15 at the top of the combustion chamber 20 and into contact with an array of heat exchangers 40, such as those that form the screen tubes, super heater 42, the boiler bank 44 (or reheat) and the economizer 46 prior to exiting the combustor via stack 50. Deposit control chemicals and processes are known, but it is always a challenge to introduce them in a manner effective for treatment of deposits in black liquor recovery boilers. This problem has existed since the first such boilers were made and there have been only a few successes, and none which have universal effectiveness.

The art has endeavored to solve the slagging problem by the introduction of various chemicals, such as magnesium oxide or hydroxide. Magnesium hydroxide has the ability to survive the hot environment of the furnace and react with the deposit-forming compounds, raising their ash fusion temperature and thereby modifying the texture and friability of the resulting deposits.

While all effective deposit-reducing chemicals are included, such as, without limitation magnesium oxide, magnesium hydroxide, magnesium carbonate, manganese oxide, manganese hydroxide, aluminum oxide and aluminum hydroxide, magnesium hydroxide is the chemical of choice for many black liquor recovery boilers and will be used in this description as exemplary. The magnesium hydroxide reagent can be prepared in any effective manner, e.g., from brines containing calcium and other salts, usually from underground brine pools or seawater. Dolomitic lime is mixed with these brines to form calcium chloride solution, and magnesium hydroxide which is precipitated and filtered out of the solution. This form of magnesium hydroxide can be mixed with water, with or without stabilizers, to concentrations suitable for storage and handling, e.g., from 25 to 65% solids by weight. For use in the process, it is diluted as determined by computational fluid dynamics (CFD) to within the range of from 0.1 to 10%, more narrowly from 1 to 5%. When it contacts the hot gases in the combustor, it is believed reduced to submicron and/or nano-sized particles, e.g., under 200 nanometers and preferably below about 100 nanometers. Median particle sizes of from 50 to about 150 nanometers are useful ranges for the process of the invention. Other forms of MgO can also be employed where necessary or desired, e.g., "light burn" or "caustic" can be employed where it is available in the desired particle size range.

To best achieve these effects, the invention will preferably take advantage of CFD to project initial flow rates and select initial reagent introduction rates, reagent introduction location(s), reagent concentration, reagent droplet size and reagent droplet momentum. CFD is a well understood science, and it is utilized with full benefit in this case, where it is desired to supply a minimum amount of chemical for maximum effect.

The following examples are presented to further explain and illustrate the invention and are not to be taken as limiting in any regard. Unless otherwise indicated, all parts and percentages are by weight.

EXAMPLE 1

This example illustrates the effect of introducing $Mg(OH)_2$ (magnesium hydroxide) into a furnace burning 2,000 tons of black liquor per day.

The magnesium hydroxide was fed as a slurry at 2 pounds of 60 weight % slurry per ton of black liquor consumed. Density of the magnesium hydroxide slurry was approximately 12.7 pounds/gallon. Therefore, the feed rate was about 315 gallons per day for the $Mg(OH)_2$ slurry.

We have seen that the invention provides at least the following advantages: (1) tertiary air protects the nozzles used to introduce the slag-reducing chemicals from the temperatures that exist in the area above the main combustion in the lower part of the furnace, (2) extremely good mixing is achieved and (3) high utilization of deposit-reducing chemicals is achieved due to the good mixing and the ability of deposit-reducing chemical to mix with slag formers by reaching the bull nose of the boiler in the zone just preceding the heat exchangers.

The above description is for the purpose of teaching the person of ordinary skill in the art how to practice the invention. It is not intended to detail all of those obvious modifications and variations, which will become apparent to the skilled worker upon reading the description. It is intended, however, that all such obvious modifications and variations be included within the scope of the invention which is defined by the following claims. The claims are meant to cover the claimed components and steps in any sequence that is effective to meet the objectives there intended, unless the context specifically indicates the contrary.

The invention claimed is:

1. A process for reducing deposits in a black liquor recovery boiler, the process comprising: injecting and burning black liquor in a boiler by injecting it into the boiler and into contact with primary air and secondary air before collecting on a char bed in the boiler near the bottom; introducing sprays of deposit-reducing chemicals as droplets from a nozzle positioned within a duct into the gases above the injection locations for the black liquor through interlaced, tangential or concentric secondary, tertiary, and/or quarternary air ports to increase the momentum of the droplets, and adjusting the flow from at least half of the ducts to achieve plug flow and thereby help shield the injected chemical from dispersion before sufficient penetration and permits the air to carry the chemical from 60 to 95% of a distance across the boiler from the point of introduction of the sprays, whereby the flow from at least half of the ducts within the air ports is plug flow.

2. A process according to claim 1 wherein the deposit-reducing chemicals are injected into the gases above the injection locations for the black liquor through interlaced secondary air ports.

3. A process according to claim 2 wherein the secondary air comprises from 30 to 50 percent of the air supplied for combustion.

4. A process according to claim 1 wherein the deposit-reducing chemicals are injected into the gases above the injection locations for the black liquor through interlaced tertiary air ports.

5. A process according to claim 4 wherein the tertiary air comprises from 0 to 50 percent of the air supplied for combustion.

6. A process according to claim 1 wherein the deposit-reducing chemicals are injected into the gases above the injection locations for the black liquor through interlaced quaternary air ports.

7. A process according to claim 2 wherein the quaternary air comprises from 20 to 50 percent of the air supplied for combustion.

8. A process according to claim 1 wherein the deposit-reducing chemicals includes a member selected from the group consisting of magnesium oxide, magnesium hydroxide, magnesium carbonate, manganese oxide, manganese hydroxide aluminum oxide and aluminum hydroxide.

9. A process according to claim 1 wherein there are from 4 to 8 secondary, tertiary or quaternary ducts of an approximate dimension of from 4" by 4", to 18" by 18", and a horizontal length of from 2 feet to 12 feet.

* * * * *